US008844301B2

(12) United States Patent
Yamashita et al.

(10) Patent No.: US 8,844,301 B2
(45) Date of Patent: Sep. 30, 2014

(54) AIR-CONDITIONING APPARATUS

(75) Inventors: Koji Yamashita, Tokyo (JP); Hiroyuki Morimoto, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 200 days.

(21) Appl. No.: 13/574,054

(22) PCT Filed: Feb. 10, 2010

(86) PCT No.: PCT/JP2010/000833

§ 371 (c)(1),
(2), (4) Date: Jul. 19, 2012

(87) PCT Pub. No.: WO2011/099065

PCT Pub. Date: Aug. 18, 2011

(65) Prior Publication Data

US 2012/0292006 A1 Nov. 22, 2012

(51) Int. Cl.

| | |
|---|---|
| ***F25B 49/00*** | (2006.01) |
| ***F24F 3/06*** | (2006.01) |
| *F25B 13/00* | (2006.01) |
| *F25B 25/00* | (2006.01) |
| *F24F 11/00* | (2006.01) |

(52) U.S. Cl.

CPC ..... *F24F 3/06* (2013.01); *F25B 2500/222* (2013.01); *F25B 2400/12* (2013.01); *F25B 13/00* (2013.01); *F25B 49/005* (2013.01); *F25B 25/005* (2013.01); *F24F 2011/0084* (2013.01)

USPC ..... 62/126; 62/186; 62/333

(58) Field of Classification Search

CPC ..... F24F 3/06; F24F 2011/0084; F24B 13/00; F24B 2500/222; F24B 9/005; F24B 2400/12; F24B 25/005

USPC ..... 62/126, 118, 411, 419, 159, 333, 186, 62/455, 513; 165/200, 104.14, 96

See application file for complete search history.

(56) References Cited

U.S. PATENT DOCUMENTS 4,254,636 A * 3/1981 Zebuhr ..... 62/325
5,347,826 A * 9/1994 Hayashida et al. ..... 62/197

(Continued)

FOREIGN PATENT DOCUMENTS

JP 5-280818 A 10/1993
JP 9-72627 A 3/1997

(Continued)

OTHER PUBLICATIONS

Office Action (Notice of Reasons for Rejection) dated Jun. 4, 2013, issued by the Japanese Patent Office in the corresponding Japanese Patent Application No. 2011-553622 and an English translation thereof. (7 pages).

(Continued)

*Primary Examiner* — Mohammad M Ali

(74) *Attorney, Agent, or Firm* — Buchanan Ingersoll & Rooney

(57) ABSTRACT

An air-conditioning apparatus includes a heat medium relay unit accommodating heat exchangers for exchanging heat between a flammable refrigerant and a heat medium different from the refrigerant. The heat medium relay unit is disposed in a space in a structure that is not an air conditioned space. One or more outdoor units are connected to the heat medium relay unit to circulate the refrigerant therein. The outdoor units are disposed in a space outside the structure or a space inside the structure that is not isolated completely from the space outside the structure. One or more indoor units are connected to the heat medium relay unit by a different system than that of the outdoor units. The indoor units circulate the heat medium therein to exchange heat with air related to the indoor space.

15 Claims, 9 Drawing Sheets

(56) References Cited

U.S. PATENT DOCUMENTS

| | | | | |
|---|---|---|---|---|
| 5,415,006 | A * | 5/1995 | Renken et al. | 62/196.4 |
| 6,393,856 | B1 * | 5/2002 | Gunji et al. | 62/298 |
| 6,460,364 | B1 * | 10/2002 | Tufo | 62/285 |
| 7,493,775 | B2 * | 2/2009 | Shimamoto et al. | 62/199 |
| 7,984,620 | B2 * | 7/2011 | Shimamoto et al. | 62/324.1 |
| 2006/0254294 | A1 * | 11/2006 | Shimamoto et al. | 62/238.7 |
| 2007/0157650 | A1 * | 7/2007 | Takegami et al. | 62/230 |
| 2008/0196432 | A1 * | 8/2008 | Shimamoto et al. | 62/238.7 |
| 2009/0145151 | A1 * | 6/2009 | Wakamoto et al. | 62/259.1 |

FOREIGN PATENT DOCUMENTS

| | | | |
|---|---|---|---|
| JP | 2001-289465 | A | 10/2001 |
| JP | 2001-317884 | A | 11/2001 |
| JP | 2002-267293 | A | 9/2002 |
| JP | 2003-343936 | A | 12/2003 |
| JP | 2004-252534 | A | 9/2004 |
| JP | 2005-128823 | A | 5/2005 |
| JP | 2005-140444 | A | 6/2005 |
| JP | 2005-201603 | A | 7/2005 |
| JP | 2006-3079 | A | 1/2006 |
| JP | 2006-38323 | A | 2/2006 |
| JP | 2007-321995 | A | 12/2007 |
| JP | 2009-162403 | A | 7/2009 |
| JP | 2009-257652 | A | 11/2009 |
| JP | 2010-2162 | A | 1/2010 |
| WO | 2009107364 | A1 | 9/2009 |

OTHER PUBLICATIONS

International Search Report (PCT/ISA/210) issued on May 11, 2010, by the Japanese Patent Office as the International Searching Authority for International Application No. PCT/JP2010/000833.

Chinese Office Action (First Office Action) dated May 5, 2014, issued in corresponding Chinese Office Application No. 201080063510.3 and an English translation thereof. (20 pgs).

* cited by examiner

AIR-CONDITIONING APPARATUS

TECHNICAL FIELD

The present invention relates to an air-conditioning apparatus that is applied to, for example, a multi-air-conditioning apparatus for a building.

BACKGROUND ART

In conventional air-conditioning apparatuses such as a multi-air-conditioning apparatus for a building, cooling operation or heating operation is carried out by circulating a refrigerant between an outdoor unit that is a heat source device disposed outdoors and indoor units disposed indoors. Specifically, an air conditioned space is cooled with the air that has been cooled by the refrigerant removing heat from the air and is heated with the air that has been heated by the refrigerant transferring its heat. As refrigerants used in such air-conditioning apparatuses, an HFC (hydrofluorocarbon) based refrigerant is widely used, for example, and further, ones using natural refrigerants such as carbon dioxide ($CO_2$) has been proposed. In either case, a nonflammable refrigerant is used.

On the other hand, there is an air-conditioning apparatus having a different configuration represented by a chiller system. Further, in such an air-conditioning apparatus, cooling or heating is carried out such that cooling energy or heating energy is generated in a heat source device disposed outdoors; a heat medium such as water or brine is heated or cooled in a heat exchanger disposed in an outdoor unit; and the heat medium is conveyed to indoor units, such as a fan coil unit, a panel heater, or the like, disposed in the air conditioned space (for example, see Patent Literature 1).

Moreover, there is a heat source side heat exchanger called a heat recovery chiller that connects a heat source unit to each indoor unit with four water pipings arranged therebetween, supplies cooled and heated water or the like simultaneously, and allows the cooling and heating in the indoor units to be selected freely (for example. see Patent Literature 2).

In addition, there is an air-conditioning apparatus that disposes a heat exchanger for a primary refrigerant and a secondary refrigerant near each indoor unit to which the secondary refrigerant is conveyed (see Patent Literature 3, for example).

Furthermore, there is an air-conditioning apparatus that connects an outdoor unit to each branch unit including a heat exchanger with two pipings in which a secondary refrigerant is carried to the corresponding indoor unit (see Patent Literature 4, for example).

CITATION LIST

Patent Literature

Patent Literature 1: Japanese Unexamined Patent Application Publication No. 2005-140444 (p. 4, FIG. 1, for example)

Patent Literature 2: Japanese Unexamined Patent Application Publication No. 5-280818 (pp. 4 and 5, FIG. 1, for example)

Patent Literature 3: Japanese Unexamined Patent Application Publication No. 2001-289465 (pp. 5 to 8, FIG. 1, FIG. 2, for example)

Patent Literature 4: Japanese Unexamined Patent Application Publication No. 2003-343936 (p. 5, FIG. 1)

SUMMARY OF INVENTION

Technical Problem

In an air-conditioning apparatus of the related art, such as a multi-air-conditioning apparatus for a building, a refrigerant may leak into, for example, an indoor space since the refrigerant is circulated to an indoor unit. Accordingly, only nonflammable refrigerants are used as the refrigerant and, from safety considerations, even if a refrigerant has a low global warming potential, flammable refrigerants could not be used. On the other hand, in air-conditioning apparatuses disclosed in Patent Literature 1 and Patent Literature 2, the refrigerant circulates only in the heat source unit disposed outdoors without the refrigerant passing through the indoor unit, such that even if a flammable refrigerant is used as the refrigerant, no refrigerant will leak into the indoor space.

However, in the air-conditioning apparatus disclosed in Patent Literature 1 and Patent Literature 2, since the heat medium needs to be heated or cooled in a heat source unit disposed outside a structure and needs to be conveyed to the indoor unit side, the circulation path of the heat medium becomes long. In this case, while heat for a certain heating or cooling work is conveyed, if the circulation path is long, energy consumption of the conveyance power becomes exceedingly large compared to the energy consumption of an air-conditioning apparatus that conveys the refrigerant into the indoor unit. This indicates that energy saving can be achieved in an air-conditioning apparatus if the circulation of the heat medium can be controlled appropriately.

In the air-conditioning apparatus disclosed in Patent Literature 2, arrangement of the four pipings connecting the outdoor side and the indoor space is needed in order to allow cooling or heating to be selected in each indoor unit. Disadvantageously, there is little ease of construction. In the air-conditioning apparatus disclosed in Patent Literature 3, secondary medium circulating means such as a pump needs to be provided to each indoor unit. Disadvantageously, the system is not only costly but also creates large noise, and is not practical. In addition, since the heat exchanger is disposed near each indoor unit, the risk of refrigerant leakage to a place near an indoor space cannot be eliminated and thus has not allowed the use of flammable refrigerants.

In the air-conditioning apparatus disclosed in Patent Literature 4, a primary refrigerant that has exchanged heat flows into the same passage as that of the primary refrigerant before heat exchange. Accordingly, when a plurality of indoor units is connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipings. Accordingly, there is little ease of construction in such a system.

The present invention has been made to overcome the above-described problems and provides an air-conditioning apparatus capable of insuring safety related to refrigerants while saving energy. Much of the flammable refrigerant is a refrigerant with low global warming potential. If the flammable refrigerant can be used as the refrigerant, adverse effect to the global environment can be reduced. Even if a flammable refrigerant is used, since the refrigerant is not circulated to the indoor unit or near the indoor unit, refrigerant leakage into the indoor space can be prevented and an air-conditioning apparatus with high safety can be obtained. Furthermore, the number of pipings connecting an outdoor unit to a branch unit (heat medium relay unit) or the branch unit to an indoor unit is reduced and ease of construction is improved as well as improvement of energy efficiency.

Solution to Problem

The air-conditioning apparatus of the invention includes a heat medium relay unit including a heat exchanger related to heat medium that exchanges heat between a flammable refrigerant and a heat medium different from the refrigerant and including a housing having a vent hole allowing ventilation between a housing space and a space outside the housing space, the heat medium relay unit disposed in a non-air conditioned space in a structure that is not an air conditioned space; a single or a plurality of outdoor units being connected to the heat medium relay unit by piping and circulating the refrigerant therein, the single or the plurality of outdoor units being disposed in a space outside the structure or a space inside the structure that is not isolated completely from the space outside the structure; and a single or a plurality of indoor units being connected to the heat medium relay unit by piping to a different system to that of the one or the plurality of outdoor units, the single or the plurality of indoor units circulating the heat medium therein to exchange heat with air related to the air conditioned space, in which the air-conditioning apparatus is capable of improving safety while achieving improvement in energy saving.

Advantageous Effects of Invention

The air-conditioning apparatus of the invention circulates a heat medium in an indoor unit for heating or cooling air of an air conditioned space and does not circulate any refrigerant in the indoor unit. Thus, even if a flammable refrigerant were to leak out from a piping or the like, for example, penetration of the refrigerant into the air conditioned space such as an indoor space can be restrained, and a safe air-conditioning apparatus can be obtained. Furthermore, since the piping circulating the medium can be shortened compared to that of an air-conditioning apparatus such as a chiller, conveyance power can be smaller. Hence, energy saving can be achieved. Furthermore, since a refrigerant with low global warming potential can be used, preservation of the global environment can be achieved.

DESCRIPTION OF EMBODIMENT

Figure 1:
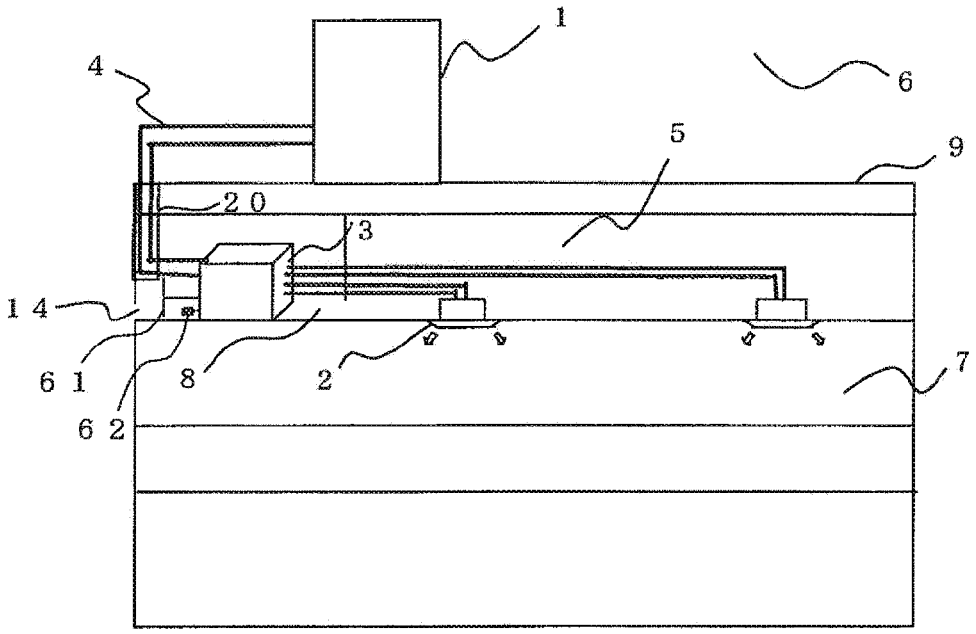
FIG. 1 is a system configuration diagram of an air-conditioning apparatus according to Embodiment of the invention.
Figure 2:
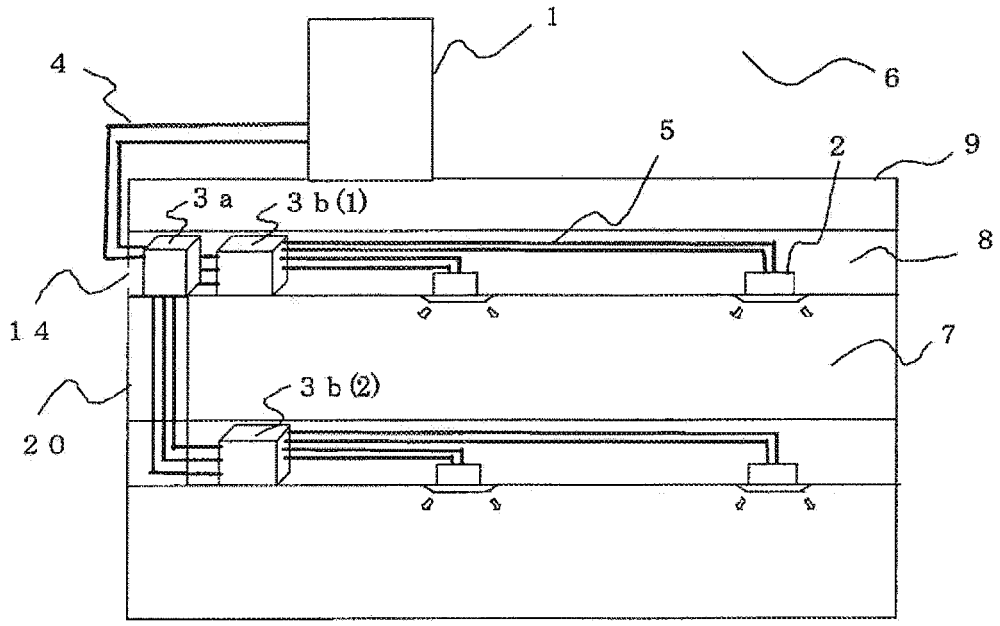
FIG. 2 is another system configuration diagram of an air-conditioning apparatus of Embodiment according to the invention.

Embodiment of the invention will be described with reference to the accompanying drawings. FIGS. 1 and 2 are schematic diagrams illustrating exemplary installations of the air-conditioning apparatus according to Embodiment of the invention. The exemplary installations of the air-conditioning apparatus will be described with reference to FIGS. 1 and 2. This air-conditioning apparatus utilizes refrigeration cycles (a refrigerant circuit A and a heat medium circuit B) in which refrigerants (a heat source side refrigerant and a heat medium) circulate so that a cooling mode or a heating mode can be freely selected as an operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipings 4 through which the heat source side refrigerant flows. The heat medium relay unit 3 and each indoor unit 2 are connected with pipings 5 (heat medium pipings) through which the heat medium flows. Cooling energy or heating energy generated in the outdoor unit 1 is delivered through the heat medium relay unit 3 to the indoor units 2.

Referring to FIG. 2, the air-conditioning apparatus according to Embodiment includes the single outdoor unit 1, the plurality of indoor units 2, a plurality of separated heat medium relay units 3 (a main heat medium relay unit 3*a* and sub heat medium relay units 3*b*) disposed between the outdoor unit 1 and the indoor units 2. The outdoor unit 1 and the main heat medium relay unit 3*a* are connected with the refrigerant pipings 4. The main heat medium relay unit 3*a* and the sub heat medium relay units 3*b* are connected with the refrigerant pipings 4. Each sub heat medium relay unit 3*b* and each indoor unit 2 are connected with the pipings 5. Cooling energy or heating energy generated in the outdoor unit 1 is delivered through the main heat medium relay unit 3*a* and the sub heat medium relay units 3*b* to the indoor units 2.

The outdoor unit 1 is typically disposed in an outdoor space 6 that is a space (e.g., a roof) outside a structure 9, such as a building, and is configured to supply cooling energy or heating energy through the heat medium relay unit 3 to the indoor units 2. Each indoor unit 2 is disposed at a position that can supply cooling air or heating air to an indoor space 7, which is an indoor space (e.g., a living room) inside the structure 9, and supplies air for cooling or air for heating to the indoor space 7 that is an air conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, that is, in a non-air conditioned space, and is connected to the outdoor unit 1 through the refrigerant pipings 4 and is connected to the indoor units 2 through the pipings 5 to convey cooling energy or heating energy supplied from the outdoor unit 1 to the indoor units 2.

As illustrated in FIGS. 1 and 2, in the air-conditioning apparatus according to Embodiment, the outdoor unit 1 is connected to the heat medium relay unit 3 using two refrigerant pipings 4, and the heat medium relay unit 3 is connected to each indoor unit 2 using a set of two pipings 5. As described above, in the air-conditioning apparatus according to Embodiment, each of the units (the outdoor unit 1, the indoor units 2, and the heat medium relay unit 3) are connected using two pipings (the refrigerant pipings 4 or the pipings 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) derived from the main heat medium relay unit 3*a*. This separation allows a plurality of sub heat medium relay units 3*b* to be connected to the single main heat medium relay unit 3*a*. In this configuration, the number of refrigerant piping 4 connecting the main heat medium relay unit 3*a* to each sub heat medium relay unit 3*b* is three. Detail of this circuit will be described in detail later.

Furthermore, FIGS. 1 and 2 illustrate a state where each heat medium relay unit 3 is disposed in the structure 9 but in a space different from the indoor space 7, for example, a non-air conditioned space such as a space above a ceiling (hereinafter, simply referred to as a "space 8"). Space 8 according to Embodiment is not a closed space and is structured to allow ventilation to the outdoor space 6 by means of a vent hole 14 provided in the structure 9. Note that as regards the vent hole 14 of the structure 9, basically, the shape and the like is not limited. The vent hole 14 may be any that is configured to allow ventilation so that, if the refrigerant were to leak into the space 8, the refrigerant is discharged to the outdoor space 6 by free convection or forced convection such that the concentration of the refrigerant in the space 8 does not become excessively high. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out air for heating or air for cooling into the indoor space 7 directly or through a duct or the like.

A flammable refrigerant is assumed to be used in such air-conditioning apparatuses of Embodiment in FIGS. 1 and 2. As regards the flammable refrigerant, for example, when a refrigerant described as a chemical formula of $CF_3CF{=}CH_2$, which possess one double bond in its molecule structure, and known to have a relativity low global warming potential is used, the environmental load can be reduced. Alternatively, other refrigerants that is not described as a chemical formula of $CF_3CF{=}CH_2$ but as $C_3H_mF_n$ (where m and n are integers of 1 to 5, and the relationship of m+n=6 holds) and that possess one double bond in its molecule structure may be used. Furthermore, it can be a mixed refrigerant containing the above. In case of a mixed refrigerant, the ratio of the refrigerant having a double bond to the entire mass of the mixed refrigerant is, by mass %, 20% to 90%. Further, if it is a mixed refrigerant containing an HFC refrigerant, due to the physical property of the refrigerant, a system with high operating efficiency can be configured. For example, if the mass % of the refrigerant having a double bond is 20 mass %, the HFC refrigerant will be 80 mass %, and if the mass % of the refrigerant having a double bond is 90 mass %, the HFC refrigerant will be 10 mass %. When HFC32 is added to $CF_3CF{=}CH_2$, since it will turn into a nonazeotropic refrigerant, there will be, due to its physical property, a temperature gradient during the condensation process and volatilization process. However, the refrigerant suction density of the compressor can be controlled, and in some cases the performance becomes better compared to that when $CF_3CF{=}CH_2$ is used alone. Preferably, it may be 80 mass % $CF_3CF{=}CH_2$, 20 mass % HFC32 or 40 mass % $CF_3CF{=}CH_2$, 60 mass % HFC32. Alternatively, HFC32 that is a HFC refrigerant with flammability may be used alone. These refrigerants are flammable but are categorized as having low flammability, and compared to refrigerants having high flammability, such as propane, the concentration flammability limits are relatively high. Thus, ventilation amounting to that of a free convection can keep the concentration during a refrigerant leakage under the concentration flammability limit. Further, if the amount of ventilation is increased with forced convection, refrigerants with high flammability, such as propane, can be used.

Accordingly, other than the space above a ceiling, the heat medium relay unit 3 may be disposed in any place that is a space other than a living space and that has a ventilation of any kind to the outdoor space 6. For example, it is possible to dispose the heat medium relay unit 3 in a common space where an elevator or the like is installed and where there is ventilation to the outdoor space 6.

Although FIGS. 1 and 2 illustrate the case in which the outdoor unit 1 is disposed in the outdoor space 6, the arrangement is not limited to this case. For example, the outdoor unit 1 can be disposed in the structure 9 or the like as long as there is ventilation to the outdoor space 6, such as an enclosed machine room with a ventilation opening.

Additionally, the numbers of connected outdoor unit 1, indoor units 2, and heat medium relay units 3 are not limited to those illustrated in FIGS. 1 and 2. The numbers thereof can be determined in accordance with the structure 9 where the air-conditioning apparatus according to Embodiment is installed.

Further, in order to prevent the refrigerant from leaking into the indoor space 7 in a case where there is a refrigerant leakage from the heat medium relay unit 3, it is desirable to shut off the indoor space 7 from the space 8 where the heat medium relay unit 3 is disposed to prevent air flowing therebetween. Even in a case in which there is a small vent hole between the space 8 and the indoor space 7 made by a run through hole for the piping 5, for example, if the ventilation resistance between the space 8 and the indoor space 7 is set larger than the ventilation resistance of the vent hole 14 between the space 8 and the outdoor space 6, then, the refrigerant that has leaked out will not leak into the indoor space 7 and will be discharged out to the outdoor space 6, and thus will cause no problem.

Furthermore, as illustrated in FIGS. 1 and 2, the refrigerant pipings that connect the outdoor unit 1 and the heat medium relay unit 3 are passed through the outdoor space 6 or through a pipe shaft 20 that is in the indoor space 7. Since the pipe shaft 20 is a duct for passing the pipings through and is surrounded on its outer surface with metal and the like, even if refrigerant were to leak out from the piping, it will not be diffused to the surroundings. Additionally, since the pipe shaft 20 is disposed in a non-air conditioned space other than the living space or in the outdoor space 6, the refrigerant that has leaked out from the piping will be discharged to the outdoor space 6 from the pipe shaft 20 through the space 8 or directly to the outdoor space 6, and will not leak into the indoor space 7. Alternatively, the heat medium relay unit 3 may be disposed in the pipe shaft.

Figure 3:
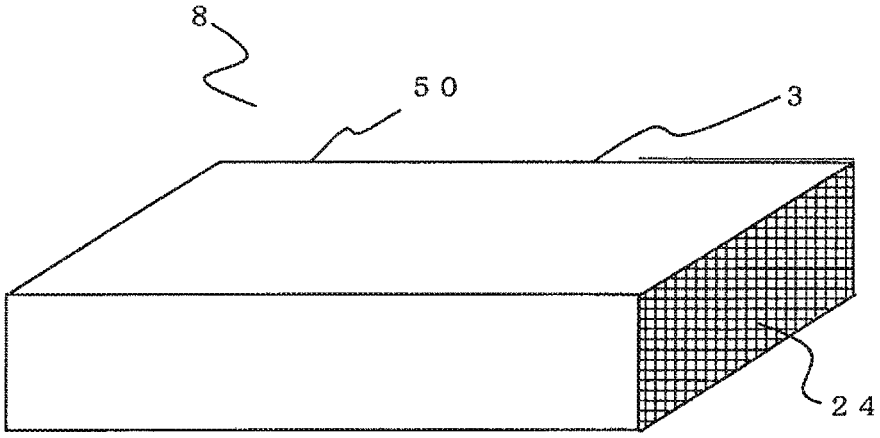
FIG. 3 is a structural drawing of a heat medium relay unit of an air-conditioning apparatus according to Embodiment of the invention.

FIG. 3 is a diagram illustrating the structure of the heat medium relay unit 3 according to Embodiment. As illustrated in FIG. 3, the heat medium relay unit 3 includes a housing 50 for housing components performing its function. In Embodiment, at least a portion of this housing 50 is provided with a vent hole 24 that allows ventilation between the housing space in the housing 50 and the space 8 in which the heat medium relay unit 3 is disposed (space outside the housing). It is desirable that this vent hole 24 is one with an opening area that is as large as possible and with a small ventilation resistance. However, if the opening area is too large, the strength will drop, and the components in the housing 50 may not be protected. Further, the noise generated by the components and the noise of the refrigerant passing through the heat medium relay unit 3, and the like will be propagated to the surroundings.

Hence, a portion of the housing 50 may have small processed holes of a perforated metal as vent holes 24 or one or more vent holes may be provided on each facing sides of the housing 50 so that even if the opening area of each vent hole 24 is not large, ventilation is facilitated by the structure.

Figure 4:
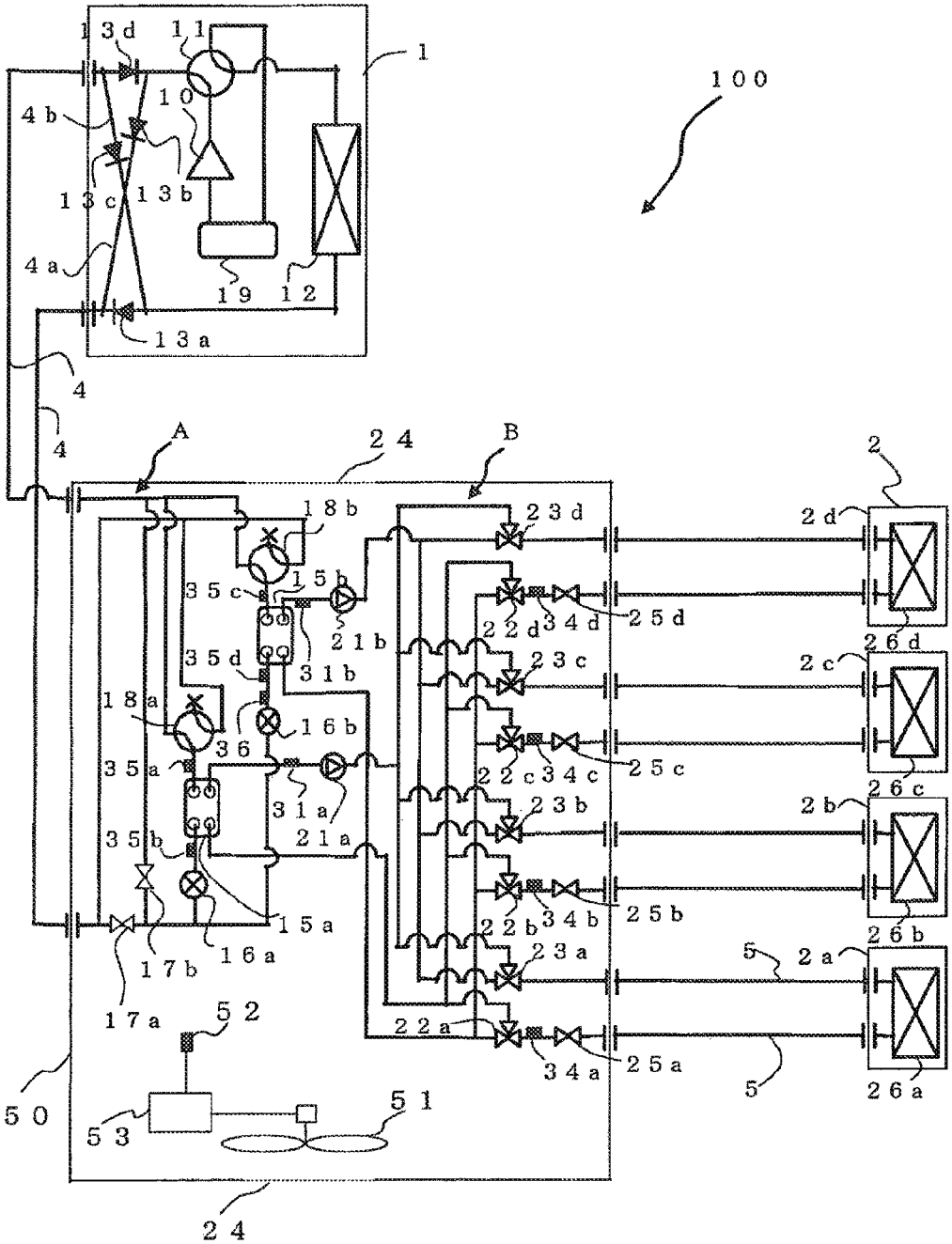
FIG. 4 is a system circuit diagram of an air-conditioning apparatus according to Embodiment of the present invention.

FIG. 4 is a schematic circuit diagram illustrating an exemplary circuit configuration of the air-conditioning apparatus (hereinafter, referred to as an "air-conditioning apparatus 100") according to Embodiment of the invention. As illustrated in FIG. 4, vent holes 24 and a fan 51 may be disposed in the heat medium relay unit 3. With the above configuration, even if the opening areas of the vent holes 24 are not so large, by the function of the fan 51, the refrigerant that has leaked into the heat medium relay unit 3 can be discharged to the outdoor space 6 through the space 8 surrounding the housing 50.

Further, a refrigerant concentration sensor 52 serving as a refrigerant concentration detection device for detecting the concentration of the refrigerant may be disposed in the housing 50 of the heat medium relay unit 3. The fan 51 disposed in the heat medium relay unit 3 may be controlled such that the concentration of the refrigerant in the housing of the heat medium relay unit 3 is not less than a certain value.

Even if the refrigerant is flammable, unless the concentration exceeds a certain concentration, the flame will not spread. Accordingly, even if the refrigerant were to leak into the housing 50 and the space 8, by controlling the refrigerant concentration to be at or under a certain level, it can be used safely. As regards the control of the fan 51, a control device 53 may allow the fan 51 to perform ON/OFF operations or may control the rotation speed of the fan 51, based on the concentration according to the detection of the refrigerant concentration sensor 52. Further, the fan 51 may be driven at all times, for example. In the above case, the concentration of the refrigerant in the heat medium relay unit 3 can be made to be at or under a certain value without disposing the refrigerant concentration sensor 52.

Additionally, a refrigerant concentration sensor 62 for the space, serving as a refrigerant concentration detection device detecting the concentration of the refrigerant, may be disposed in the space 8. Furthermore, by providing a fan 61 for the space in a position where air can be sent from the space 8 to the outdoor space 6, and by controlling the fan 61 for the space such that the concentration of the refrigerant in the space 8 is not less than a certain value, it can be used in a further safe manner. As regards the control of the fan 61 for the space, the above-mentioned control device 53 may allow the fan 51 to perform ON/OFF operations based on the concentration of the refrigerant detected by the refrigerant concentration sensor 62 for the space. The rotation speed of the fan 61 for the space may be controlled. Further, if the fan 61 for the space is driven at all times, the concentration of the refrigerant in the space 8 can be made to be at or under a certain value without disposing the refrigerant concentration sensor 62 for the space.

Note that the vent hole 14 of the structure 9 does not have to be a hole that is opened in a wall, but may be a gap in the wall or any of the type that has a sufficient opening area in view of the entire space 8 to the outdoor space 6.

Next, the detailed configuration of the air-conditioning apparatus 100 will be described with reference to FIG. 4. As illustrated in FIG. 4, the outdoor unit 1 and the heat medium relay unit 3 are connected with the refrigerant pipings 4 through heat exchangers related to heat medium 15*a* and 15*b* included in the heat medium relay unit 3. Furthermore, the heat medium relay unit 3 and the indoor units 2 are connected with the pipings 5 through the heat exchangers related to heat medium 15*a* and 15*b*. Note that the refrigerant piping 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipings 4. The outdoor unit 1 further includes a first connecting piping 4*a*, a second connecting piping 4*b*, a check valve 13*a*, a check valve 13*b*, a check valve 13*c*, and a check valve 13*d*. By providing the first connecting piping 4*a*, the second connecting piping 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by any indoor unit 2.

The compressor 10 sucks in the heat source side refrigerant and compress the heat source side refrigerant to a high-temperature high-pressure state. The compressor 10 may include, for example, a capacity-controllable inverter compressor. The first refrigerant flow switching device 11 switches the flow of the heat source side refrigerant between a heating operation (a heating only operation mode and a heating main operation mode) and a cooling operation (a cooling only operation mode and a cooling main operation mode). The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporates and gasifies or condenses and liquefies the heat source side refrigerant. The accumulator 19 is provided on the suction side of the compressor 10 and retains excess refrigerant.

The check valve 13*d* is provided in the refrigerant piping 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant piping 4 between the heat source side heat exchanger 12 and the heat medium relay unit 3 and permits the heat source side refrigerant to flow only in a predetermined direction (the direction from the outdoor unit 1 to the heat medium relay unit 3). The check valve 13*b* is provided in the first connecting piping 4*a* and allows the heat source side refrigerant discharged from the compressor 10 to flow through the heat medium relay unit 3 during the heating operation. The check valve 13*c* is disposed in the second connecting piping 4*b* and allows the heat source side refrigerant, returning from the heat medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat medium relay unit 3, in the outdoor unit 1. The second connecting piping 4*b* is configured to connect the refrigerant piping 4, between the check valve 13*d* and the heat medium relay unit 3, to the refrigerant piping 4, between the heat source side heat exchanger 12 and the check valve 13*a*, in the outdoor unit 1. It should be noted that FIG. 4 illustrates a case in which the first connecting piping 4*a*, the second connecting piping 4*b*, the check valve 13*a*, the check valve 13*b*, the check valve 13*c*, and the check valve 13*d* are disposed, but the device is not limited to this case, and they may be omitted.

[Indoor Units 2]

The indoor units 2 each include a use side heat exchanger 26. The use side heat exchanger 26 is connected to a heat medium flow control device 25 and a second heat medium flow switching device 23 in the heat medium relay unit 3 with the pipings 5. Each of the use side heat exchangers 26 exchanges heat between air supplied from an air-sending device, such as a fan, (not illustrated) and the heat medium in order to generate air for heating or air for cooling supplied to the indoor space 7.

FIG. 4 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. Note that as is the case of FIGS. 1 and 2, the number of connected indoor units 2 illustrated in FIG. 4 is not limited to four.

[Heat Medium Relay Unit 3]

The heat medium relay unit 3 includes the two heat exchangers related to heat medium 15, two expansion devices 16, two on-off devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 4A.

Each of the two heat exchangers related to heat medium 15 (the heat exchanger related to heat medium 15*a* and the heat exchanger related to heat medium 15*b*) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to heat the heat medium in the cooling and heating mixed operation mode. Additionally, the heat exchanger related to heat medium 15*b* is disposed between an expansion device 16*b* and a second refrigerant flow switching device 18*b* in the refrigerant circuit A and is used to cool the heat medium in the cooling and heating mixed operation mode.

The two expansion devices 16 (the expansion device 16*a* and the expansion device 16*b*) each have functions of a reducing valve and an expansion valve and are configured to reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, such as an electronic expansion valve.

The two on-off devices 17 (an on-off device 17*a* and an on-off device 17*b*) each include, for example, a two-way valve and open and close the refrigerant piping 4. The on-off device 17*a* is disposed in the refrigerant piping 4 on the inlet side of the heat source side refrigerant. The on-off device 17*b* is disposed in a piping connecting the refrigerant piping 4 on the inlet side of the heat source side refrigerant and the refrigerant piping 4 on an outlet side thereof. The two second refrigerant flow switching devices 18 (the second refrigerant flow switching devices 18*a* and 18*b*) each include, for example, a four-way valve and switch passages of the heat source side refrigerant in accordance with the operation mode. The second refrigerant flow switching device 18*a* is disposed downstream of the heat exchanger related to heat medium 15*a*, downstream regarding the heat source side refrigerant flow during the cooling operation. The second refrigerant flow switching device 18*b* is disposed downstream of the heat exchanger related to heat medium 15*b*, downstream regarding the heat source side refrigerant flow during the cooling only operation.

The two pumps 21 (a pump 21*a* and a pump 21*b*) circulate the heat medium flowing through the piping 5. The pump 21*a* is disposed in the piping 5 between the heat exchanger related to heat medium 15*a* and the second heat medium flow switching devices 23. The pump 21*b* is disposed in the piping 5 between the heat exchanger related to heat medium 15*b* and the second heat medium flow switching devices 23. Each of the two pumps 21 may include, for example, a capacity-controllable pump.

The four first heat medium flow switching devices 22 (first heat medium flow switching devices 22*a* to 22*d*) each include, for example, a three-way valve and switch passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the heat medium flow control device 25. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) each include, for example, a three-way valve and are configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the use side heat exchanger 26. Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

The four heat medium flow control devices 25 (heat medium flow control devices 25*a* to 25*d*) each include, for example, a two-way valve capable of controlling the area of opening and controls the flow rate of the flow in each piping 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

The heat medium relay unit 3 includes various detecting devices (two first temperature sensors 31, four second temperature sensors 34, four third temperature sensors 35, and a pressure sensor 36). Information (temperature information and pressure information) detected by these detecting devices are, for example, transmitted to a controller (not illustrated) that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 21, switching by the second refrigerant flow switching devices 18, and switching of passages of the heat medium. The control device 53 mentioned above may be used. Further, the control of the heat medium relay unit can be performed by the control device 53.

Each of the two first temperature sensors 31 (a first temperature sensor 31*a* and a first temperature sensor 31*b*) detects the temperature of the heat medium flowing out of the corresponding heat exchanger related to heat medium 15, namely, the heat medium at an outlet of the corresponding heat exchanger related to heat medium 15 and may include, for example, a thermistor. The first temperature sensor 31*a* is disposed in the piping 5 on the inlet side of the pump 21*a*. The first temperature sensor 31*b* is disposed in the piping 5 on the inlet side of the pump 21*b*.

Each of the four second temperature sensors 34 (second temperature sensor 34*a* to 34*d*) is disposed between the first heat medium flow switching device 22 and the heat medium flow control device 25 and detects the temperature of the heat medium flowing out of the use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Further, the controller (not illustrated) includes, for example, a microcomputer and controls, for example, the driving frequency of the compressor 10, the rotation speed (including ON/OFF) of the air-sending device, switching of the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow switching devices 23, and the opening degree of each heat medium flow control device 25 on the basis of the information detected by the various detecting devices and an instruction from a remote control to carry out the operation modes which will be described later. Note that the controller may be provided to each unit, or may be provided to the outdoor unit 1 or the heat medium relay unit 3.

The pipings 5 in which the heat medium flows include the pipings connected to the heat exchanger related to heat medium 15*a* and the pipings connected to the heat exchanger related to heat medium 15*b*. Each piping 5 is branched (into four in this case) in accordance with the number of indoor units 2 connected to the heat medium relay unit 3. The pipings 5 are connected by the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the on-off devices 17, the second refrigerant flow switching devices 18, a refrigerant passage of the heat exchanger related to heat medium 15*a*, the expansion devices 16, and the accumulator 19 are connected through the refrigerant piping 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected through the pipings 5, thus forming the heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are also connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

Figure 4A:
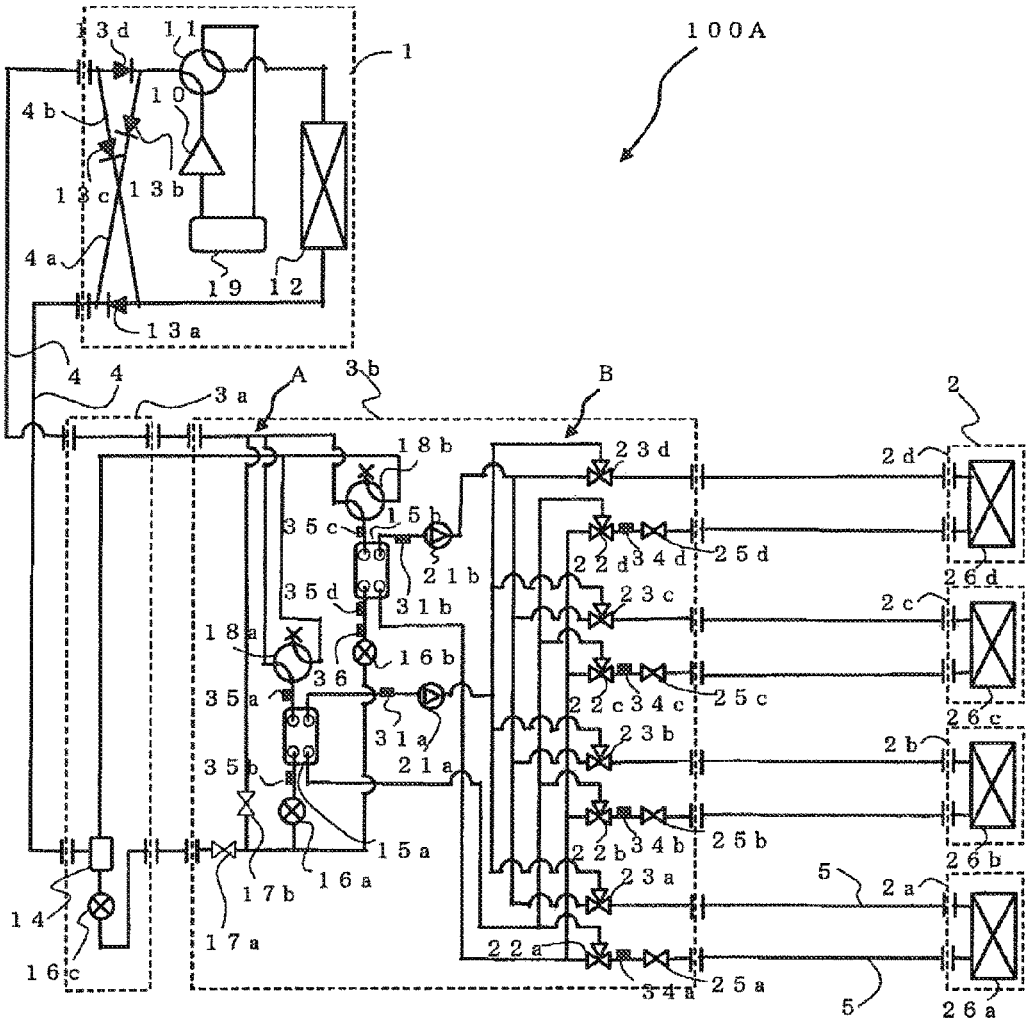
FIG. 4A is another system circuit diagram of an air-conditioning apparatus according to Embodiment of the invention.

FIG. 4A is another schematic circuit diagram illustrating an exemplary circuit configuration of the air-conditioning apparatus (hereinafter, referred to as an "air-conditioning apparatus 100A") according to Embodiment of the invention. The configuration of the air-conditioning apparatus 100A in a case in which a heat medium relay unit 4 is separated into a main heat medium relay unit 3*a* and a sub heat medium relay unit 3*b* will be described with reference to FIG. 3A. As illustrate in FIG. 4A, a housing of the heat medium relay unit 3 is separated such that the heat medium relay unit 3 is composed of the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant piping 4 connected to the outdoor unit 1 and is connected to two refrigerant pipings 4 connected to the heat exchanger related to heat medium 15*a* and the heat exchanger related to heat medium 15*b* in the sub heat medium relay unit 3*b*, and is configured to separate the heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and reduces the pressure of and expands the heat source side refrigerant. During a cooling and heating mixed operation, the expansion device 16*c* is controlled such that the pressure state of the refrigerant on an outlet side of the expansion device 16*c* is medium pressure. The expansion device 16*c* may include a component having a variably controllable opening degree, such as an electronic expansion valve. This arrangement allows a plurality of sub heat medium relay units 3*b* to be connected to the main heat medium relay unit 3*a*.

Various operation modes executed by the air-conditioning apparatus 100 will be described below. The air-conditioning apparatus 100 allows each indoor unit 2, on the basis of an instruction from the indoor unit 2, to perform a cooling operation or heating operation. Specifically, the air-conditioning apparatus 100 allows all of the indoor units 2 to perform the same operation and also allows each of the indoor units 2 to perform different operations. It should be noted that since the same applies to operation modes carried out by the air-conditioning apparatus 100A, description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. The operation modes will be described below with respect to the flow of the heat source side refrigerant and that of the heat medium.

[Cooling Only Operation Mode]

Figure 5:
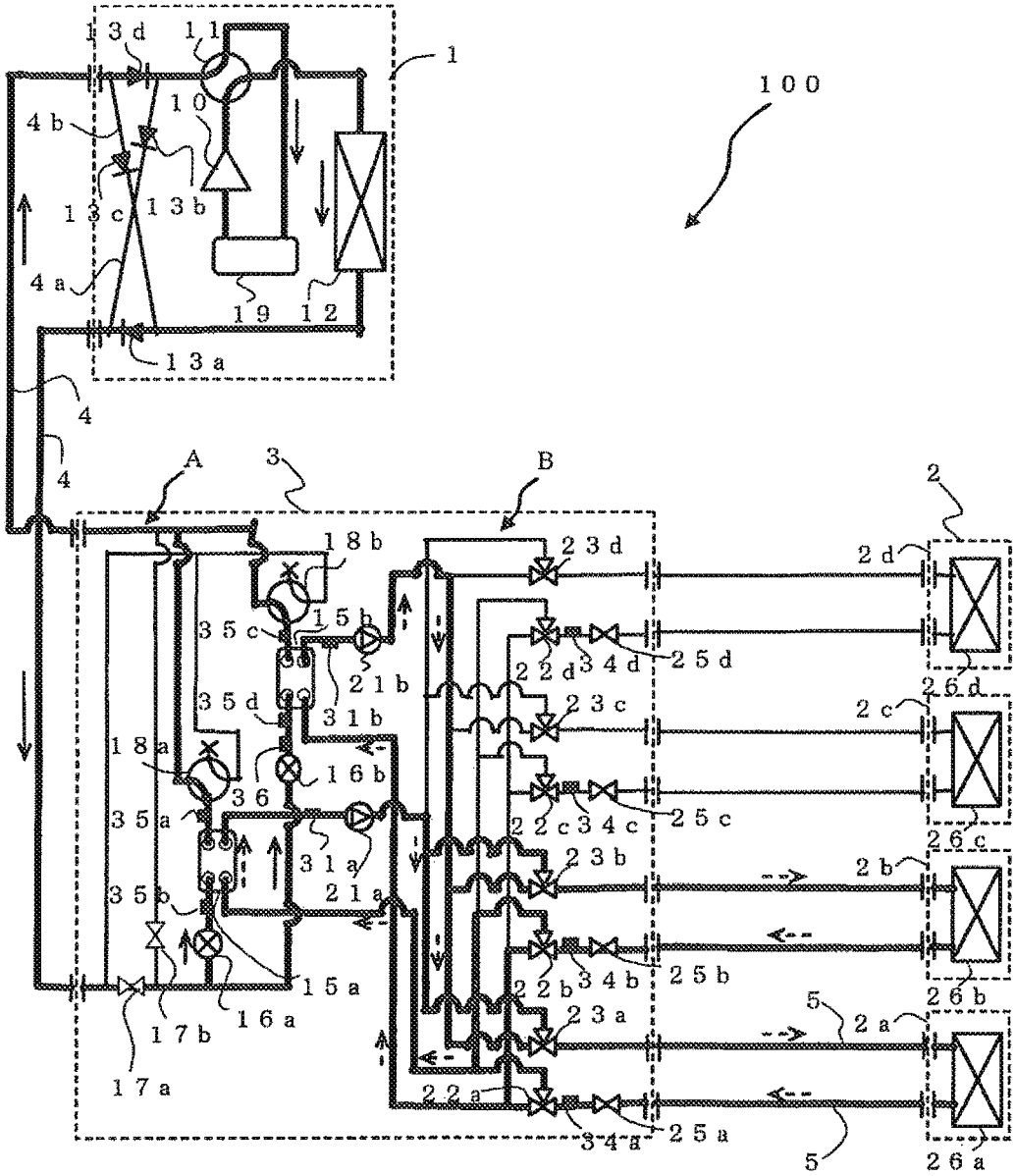
FIG. 5 is a system circuit diagram of an air-conditioning apparatus according to Embodiment during cooling only operation.

FIG. 5 is a refrigerant circuit diagram illustrating the flows of refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 5. Furthermore, in FIG. 5, pipings indicated by thick lines indicate pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 5.

In the cooling only operation mode illustrated in FIG. 5, in the outdoor unit 1, the first refrigerant flow switching device 11 is switched such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant piping 4, and flows into the heat medium relay unit 3. The high-pressure liquid refrigerant flowing into the heat medium relay unit 3 is branched after passing through the on-off device 17*a* and is expanded into a low-temperature low-pressure two-phase refrigerant by the expansion device 16*a* and the expansion device 16*b*.

This two-phase refrigerant flows into each of the heat exchanger related to heat medium 15*a* and the heat exchanger related to heat medium 15*b* functioning as an evaporator, removes heat from the heat medium circulating in the heat medium circuit B, cools the heat medium, and turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the second refrigerant flow switching device 18*a* and the second refrigerant flow switching device 18*b*, respectively, passes through the refrigerant piping 4, and again flows into the outdoor unit 1. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, in which the superheat is obtained as the difference between a temperature detected by a third temperature sensor 35*c* and that detected by a third temperature sensor 35*d*. In addition, the on-off device 17*a* is opened and the on-off device 17*b* is closed.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cools the indoor space 7.

Then, the heat medium flows out of each of the use side heat exchanger 26*a* and the use side heat exchanger 26*b* and flows into the heat medium flow control device 25*a* and the heat medium flow control device 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 6:
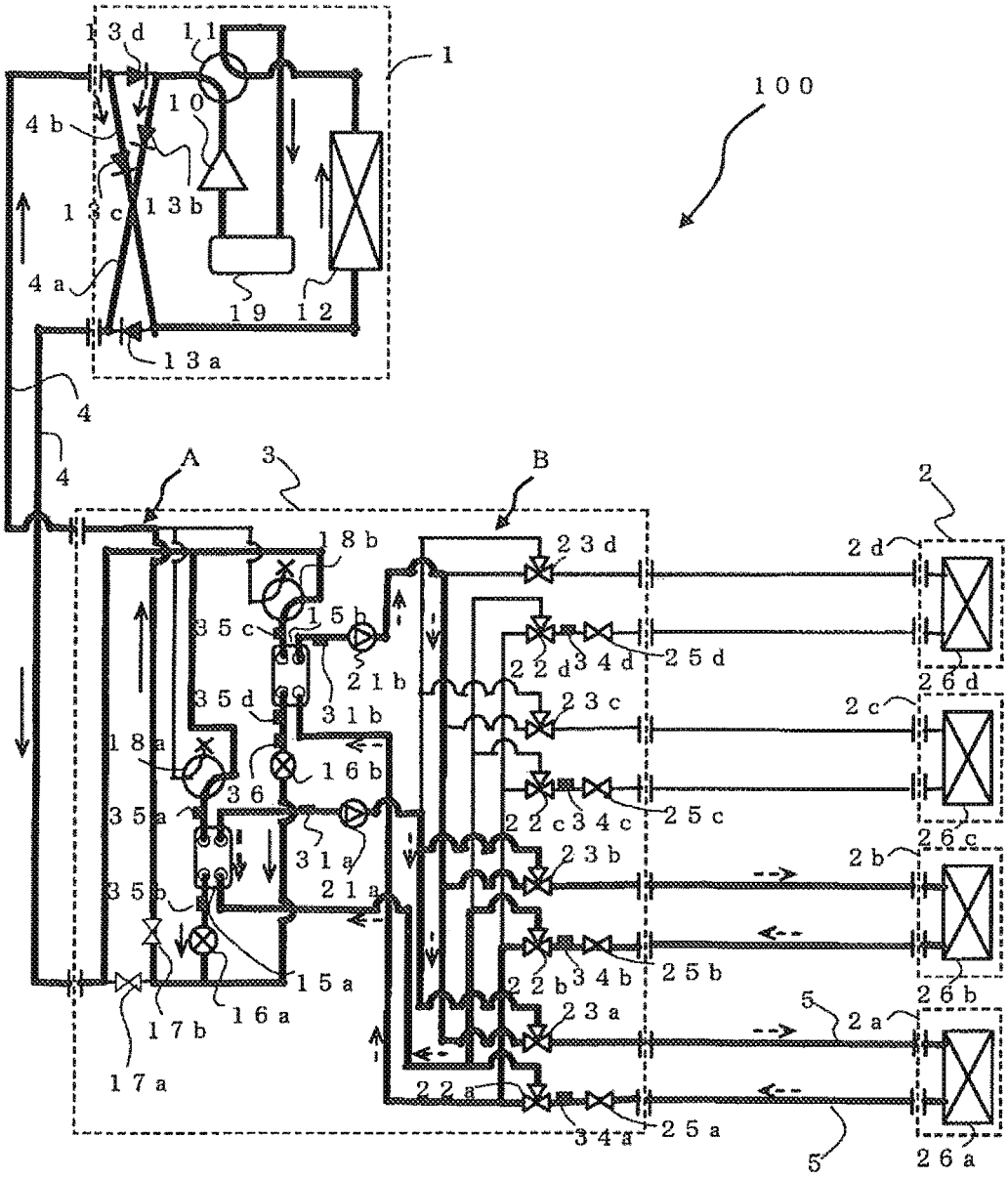
FIG. 6 is a system circuit diagram of an air-conditioning apparatus according to Embodiment during heating only operation.

FIG. 6 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 6. Furthermore, in FIG. 6, pipings indicated by thick lines indicate pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 6.

In the heating only operation mode illustrated in FIG. 6, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant that has flowed into the heat medium relay unit 3 is branched, passes through the second refrigerant flow switching device 18*a* and the second refrigerant flow switching device 18*b*, and flows into the heat exchanger related to heat medium 15*a* and the heat exchanger related to heat medium 15*b*.

The high-temperature high-pressure gas refrigerant that has flowed into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant in the expansion device 16*a* and the expansion device 16*b*. This two-phase refrigerant passes through the on-off device 17*b*, flows out of the heat medium relay unit 3, passes through the refrigerant piping 4, and again flows into the outdoor unit 1. The refrigerant flowing into the outdoor unit 1 flows through the second connecting piping 4*b*, passes through the check valve 13*c*, and flows into the heat source side heat exchanger 12 functioning as an evaporator.

Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, in which the subcooling is obtained as the difference between the value indicating the saturation temperature converted from the pressure detected by the pressure sensor 36 and a temperature detected by the third temperature sensor 35*d*. In addition, the on-off device 17*a* is closed and the on-off device 17*b* is opened. Note that when a temperature at the middle position of the heat exchangers related to heat medium 15 can be measured, the temperature at the middle position may be used instead of the pressure sensor 36. Accordingly, the system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air in the use side heat exchanger 26*a* and the use side heat exchanger 26*b*, thus heats the indoor space 7.

Then, the heat medium flows out of each of the use side heat exchanger 26*a* and the use side heat exchanger 26*b* and flows into the heat medium flow control device 25*a* and the heat medium flow control device 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. Although the use side heat exchanger 26*a* should essentially be controlled on the basis of the difference between a temperature at its inlet and that at its outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 7:
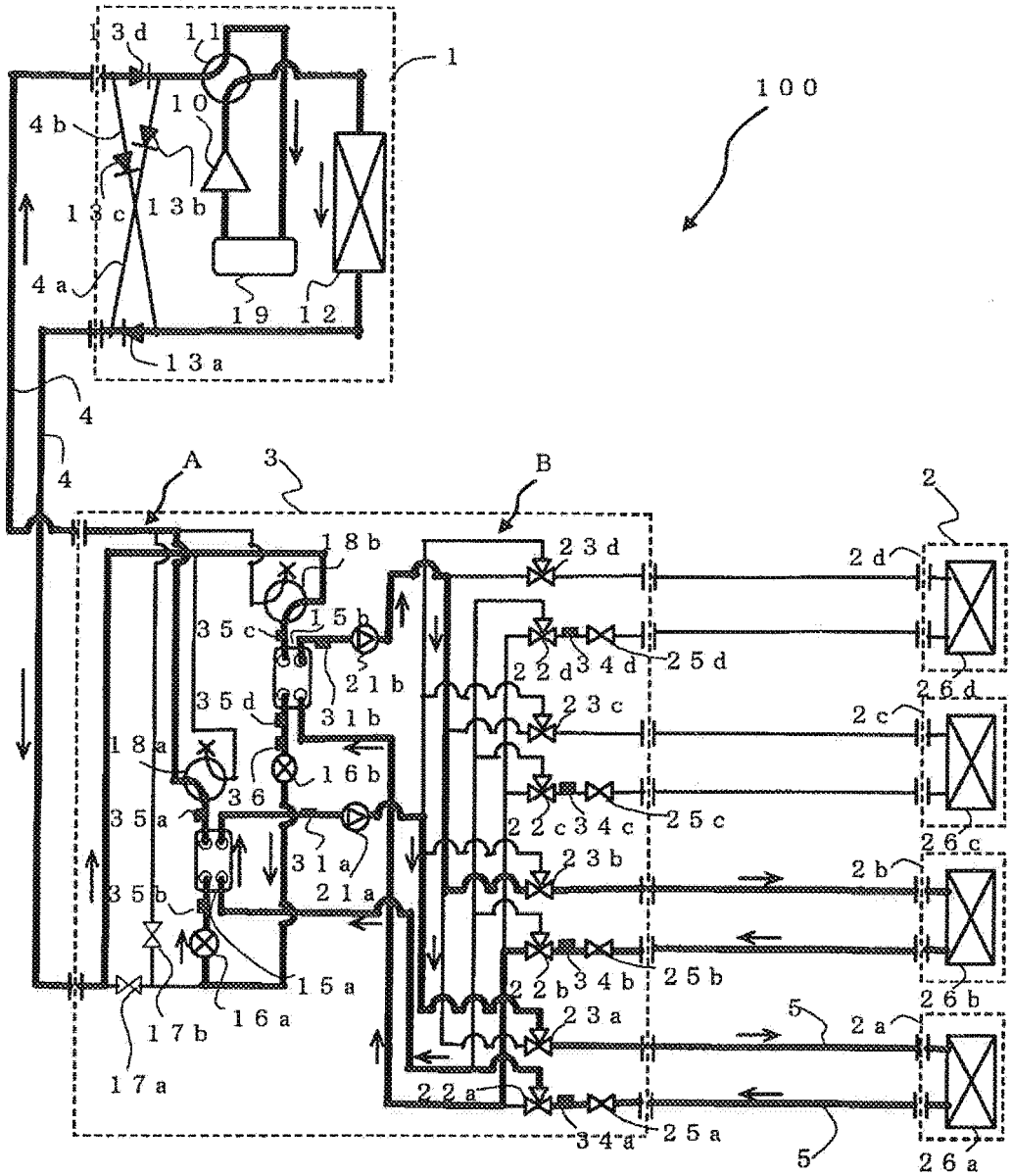
FIG. 7 is a system circuit diagram of an air-conditioning apparatus according to Embodiment during cooling main operation.

FIG. 7 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 7. Furthermore, in FIG. 7, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 7.

In the cooling main operation mode illustrated in FIG. 7, in the outdoor unit 1, the first refrigerant flow switching device 11 is switched such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchanger related to heat medium 15*a* and the use side heat exchanger 26*a*, and between the heat exchanger related to heat medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant piping 4, and flows into the heat medium relay unit 3. The two-phase refrigerant flowing into the heat medium relay unit 3 passes through the second refrigerant flow switching device 18*b* and flows into the heat exchanger related to heat medium 15*b*, functioning as a condenser.

The two-phase refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant flowing into the heat exchanger related to heat medium 15*a* removes heat from the heat medium circulating in the heat medium circuit B, cools the heat medium, and turns into a low-pressure gas refrigerant. The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant piping 4. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. Note that the opening degree of the expansion device 16*b* may be controlled such that subcooling is constant, in which the subcooling is obtained as the difference between a value indicating a saturation temperature converted from a pressure detected by the pressure sensor 36 and a temperature detected by the third temperature sensor 35*d*. Alternatively, the expansion device 16*b* may be fully opened and the expansion device 16*a* may control the superheat or the subcooling.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipings 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is sucked into the pump 21*b* again. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then sucked into the pump 21*a* again.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 7, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 8:
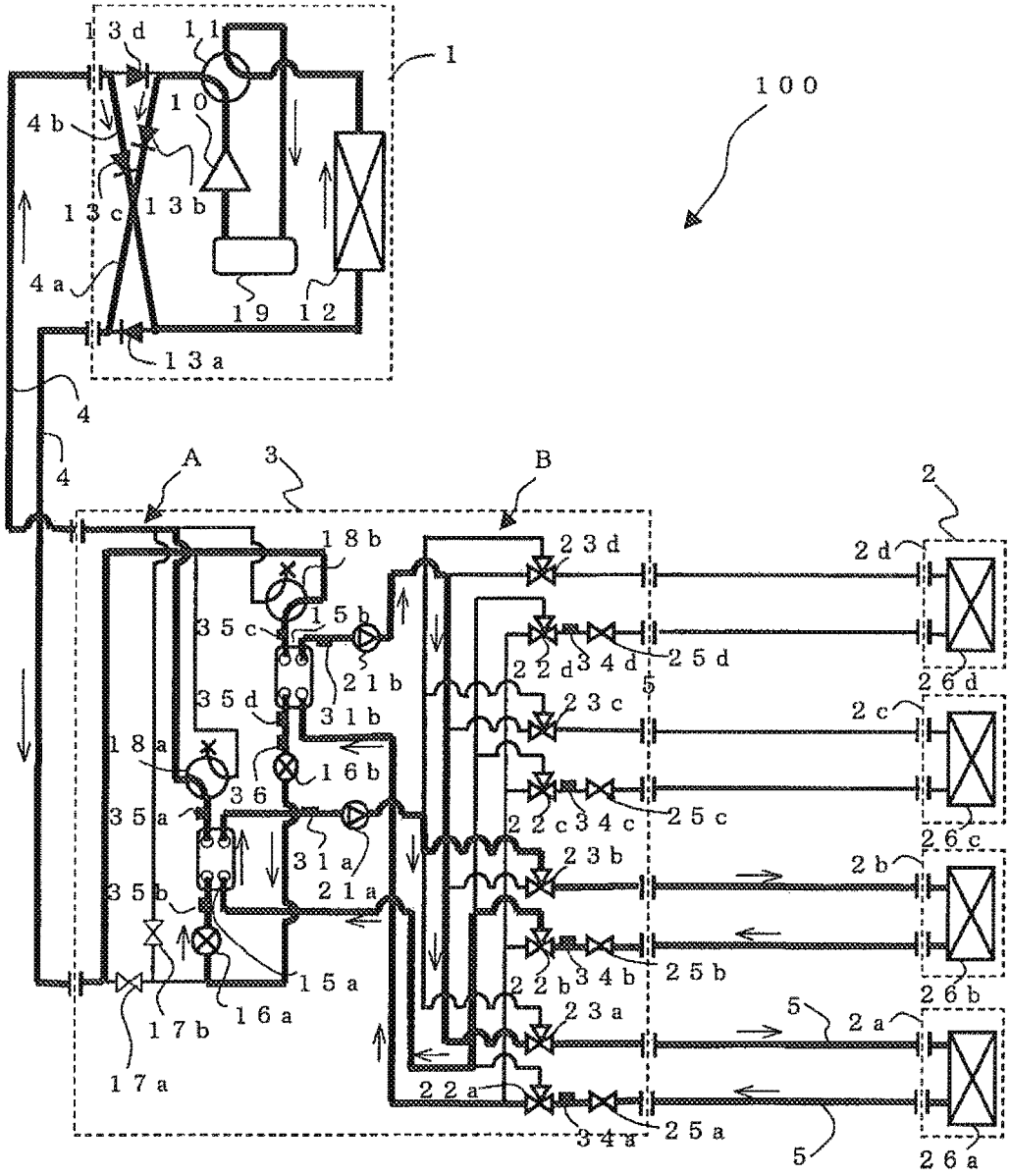
FIG. 8 is a system circuit diagram of an air-conditioning apparatus according to Embodiment during heating main operation.

FIG. 8 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 8. Furthermore, in FIG. 8, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 8.

In the heating main operation mode illustrated in FIG. 8, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant flowing into the heat medium relay unit 3 passes through the second refrigerant flow switching device 18*b* and flows into the heat exchanger related to heat medium 15*b*, functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, is evaporated, and cools the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant piping 4, and again flows into the outdoor unit 1.

The refrigerant flowing into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the pipings 5. Furthermore, in the heating main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cools the indoor space 7. In addition, in the use side heat exchanger 26*a*, the heat medium transfers heat to the indoor air, thus heats the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is sucked into the pump 21*a* again. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is again sucked into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 8, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerant Piping 4]

As described above, the air-conditioning apparatus 100 according to Embodiment 1 has several operation modes. In these operation modes, the heat source side refrigerant flows through the refrigerant pipings 4 connecting the outdoor unit 1 and the heat medium relay unit 3.

[Piping 5]

In some operation modes carried out by the air-conditioning apparatus 100 according to Embodiment, the heat medium, such as water or antifreeze, flows through the pipings 5 connecting the heat medium relay unit 3 and the indoor units 2.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are set to a medium opening degree, such that the heat medium flows into both of the heat exchanger related to heat medium 15*a* and the heat exchanger related to heat medium 15*b*. Consequently, since both the heat exchanger related to heat medium 15*a* and the heat exchanger related to heat medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in Embodiment may be any of the sort as long as they can switch passages, for example, a three-way valve capable of switching between three passages or a combination of two on-off valves and the like switching between two passages. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, while Embodiment has been described with respect to the case in which the heat medium flow control devices 25 each include a two-way valve, each of the heat medium flow control devices 25 may include a control valve having three passages and the valve may be disposed with a bypass pipe that bypasses the corresponding use side heat exchanger 26.

Furthermore, as regards each of the use side heat medium flow control device 25, a stepping-motor-driven type that is capable of controlling a flow rate in the passage is preferably used. Alternatively, a two-way valve or a three-way valve whose one end is closed may be used. Alternatively, as regards each use side heat medium flow control device 25, a component, such as an on-off valve, which is capable of opening or closing a two-way passage, may be used while ON and OFF operations are repeated to control an average flow rate.

Furthermore, while each second refrigerant flow switching device 18 has been described as if it is a four-way valve, the device is not limited to this type. The device may be configured such that the refrigerant flows in the same manner using a plurality of two-way flow switching valves or three-way flow switching valves.

While the air-conditioning apparatus 100 according to Embodiment has been described with respect to the case in which the apparatus can perform the cooling and heating mixed operation, the apparatus is not limited to the case. Even in an apparatus that is configured by a single heat exchanger related to heat medium 15 and a single expansion device 16 that are connected to a plurality of parallel use side heat exchangers 26 and heat medium flow control valves 25, and is capable of carrying out only a cooling operation or a heating operation, the same advantages can be obtained.

In addition, it is needless to say that the same holds true for the case in which only a single use side heat exchanger 26 and a single heat medium flow control valve 25 are connected. Moreover, it is needless to say that no problem will arise even if the heat exchanger related to heat medium 15 and the expansion device 16 acting in the same manner are arranged in plural numbers. Furthermore, while the case in which the heat medium flow control valves 25 are equipped in the heat medium relay unit 3 has been described, the arrangement is not limited to this case. Each heat medium flow control valve 25 may be disposed in the indoor unit 2. The heat medium relay unit 3 and the indoor unit 2 may be constituted in different housings.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is highly safe, contribution to improvement of safety can be made.

Further, although the heat source side heat exchanger 12 and the use side heat exchangers 26*a* to 26*d* are typically arranged with an air-sending device in which condensing or evaporation is facilitated by the sent air, not limited to the above, a panel heater, using radiation can be used as the use side heat exchangers 26*a* to 26*d* and a water-cooled heat exchanger which transfers heat using water or antifreeze can be used as the heat source side heat exchanger 12. Any component that has a structure that can transfer or remove heat may be used.

Furthermore, while an exemplary description in which there are four use side heat exchangers 26*a* to 26*d* has been given, any number can be connected.

Furthermore, description has been made illustrating a case in which there are two heat exchangers related to heat medium 15, namely, heat exchanger related to heat medium 15*a* and heat exchanger related to heat medium 15*b*. As a matter of course, the arrangement is not limited to this case, and as long as it is configured so that cooling and/or heating of the heat medium can be carried out, the number may be any number.

Furthermore, each of the number of pumps 21*a* and 21*b* is not limited to one. A plurality of pumps having a small capacity may be used in parallel.

Figure 9:
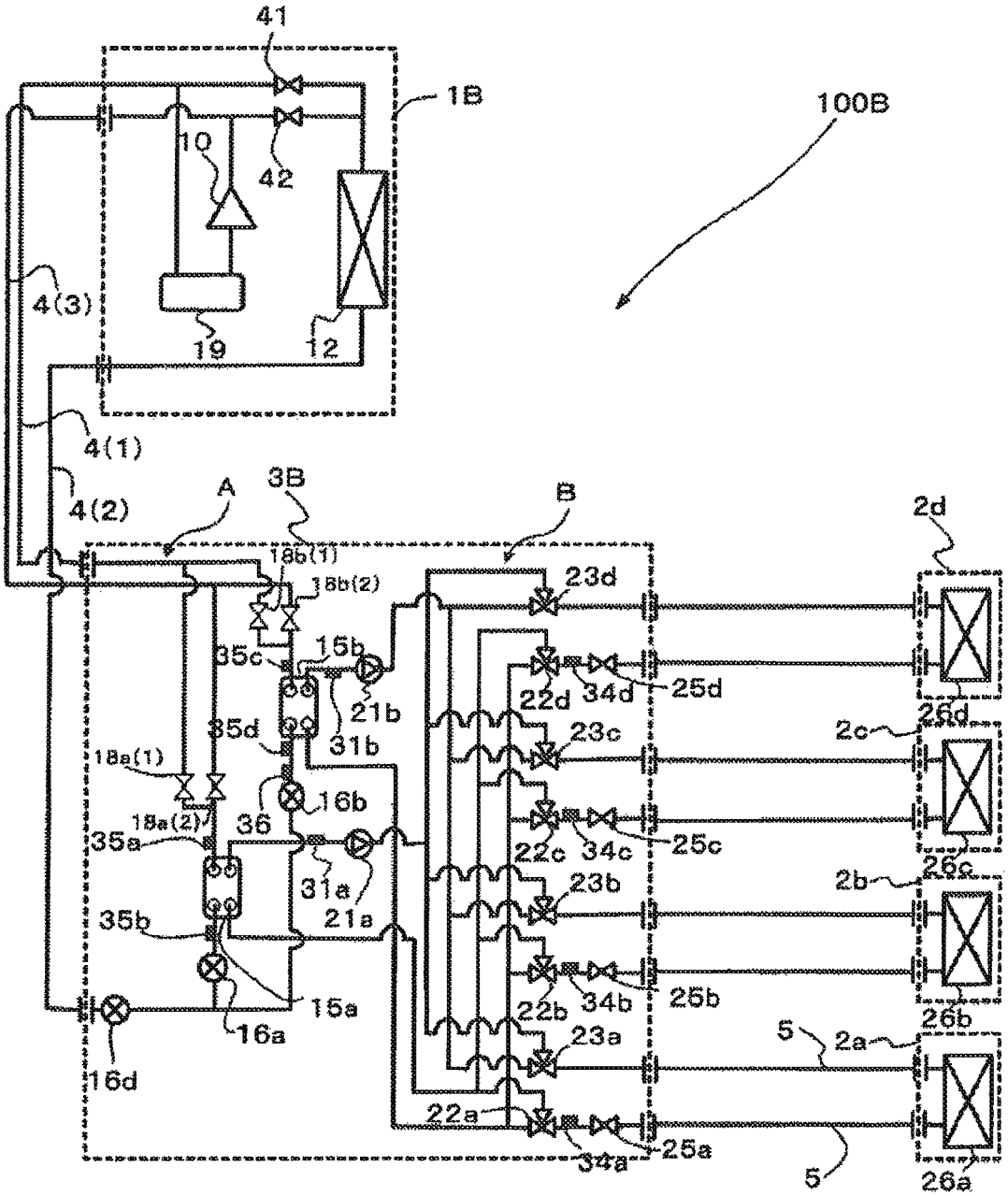
FIG. 9 is another system circuit diagram of an air-conditioning apparatus according to Embodiment of the invention.

FIG. 4A is another schematic circuit diagram illustrating an exemplary circuit configuration of the air-conditioning apparatus (hereinafter, referred to as an "air-conditioning apparatus 100B") according to Embodiment of the invention. For example, the outdoor unit (hereinafter, referred as outdoor unit 1B) and the heat medium relay unit (hereinafter, referred as heat medium relay unit 3B) are may be connected with three refrigerant pipings 4 (refrigerant piping 4(1), refrigerant piping 4(2), refrigerant piping 4(3)) as shown in FIG. 9. FIG. 9 illustrates a diagram of an exemplary installation of the air-conditioning apparatus 100B. Specifically, the air-conditioning apparatus 100B also allows all of the indoor units 2 to perform the same operation and allows each of the indoor units 2 to perform different operations. In addition, in the refrigerant piping 4(2) in the heat medium relay unit 3B, an expansion device 16*b* (for example, an electronic expansion valve) is provided for the merging high-pressure liquid during cooling main operation mode.

The general configuration of the air-conditioning apparatus 100B is the same as the air-conditioning apparatus 100 except for the outdoor unit 1B and the heat medium relay unit 3B. The outdoor unit 1B includes a compressor 10, a heat source side heat exchanger 12, an accumulator 19, two flow switching units (flow switching unit 41 and flow switching unit 42). The flow switching unit 41 and the flow switching unit 42 constitute the first refrigerant flow switching device. In the air-conditioning apparatus 100, a case in which the first refrigerant flow switching device is a four-way valve has been described, but as shown in FIG. 9, the first refrigerant switching device may be a combination of a plurality of two-way valves.

In the heat medium relay unit 3B, the refrigerant piping, which is branched from the refrigerant piping 4(2) having the on-off device 17 and is connected to the second refrigerant switching device 18*b*, is not provided and instead the second refrigerant flow switching device 18*a* (1) and the second refrigerant flow switching device 18*b* (1) are connected to the refrigerant piping 4(1), and the second refrigerant flow switching device 18*a* (2) and the second refrigerant flow switching device 18*b* (2) are connected to the refrigerant piping 4(3). Further, the expansion device 16*d* is provided and is connected to the refrigerant piping 4(2).

The refrigerant piping 4(3) connects the discharge piping of the compressor 10 to the heat medium relay unit 3B. The two flow switching units each include, for example, a two-way valve and are configured to open or close the refrigerant piping 4. The flow switching unit 41 is provided between the suction piping of the compressor 10 and the heat source side heat exchanger 12, and the control of its opening and closing switches the refrigerant flow of the heat source refrigerant. The flow switching unit 42 is provided between the discharge piping of the compressor 10 and the heat source side heat exchanger 12, and the control of its opening and closing switches the refrigerant flow of the heat source refrigerant.

Hereinafter, with reference to FIG. 9, each operation mode carried out by the air-conditioning apparatus 100 B will be described. Note that since the heat medium flow in the heat medium circuit B is the same as the air-conditioning apparatus 100, description will be omitted.

[Cooling Only Operation Mode]

In this cooling only operation mode, flow switching unit 41 is closed, and the flow switching unit 42 is opened.

A low-temperature low-pressure refrigerant is compressed by the compressor 10 and is discharged as a high-temperature high-pressure gas refrigerant therefrom. The entire high-temperature high-pressure gas refrigerant discharged from the compressor 10 flows through the flow switching unit 42 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant, which has flowed out of the heat source side heat exchanger 12, passes through the refrigerant piping 4 (2) and flows into the heat medium relay unit 3B. The high-pressure liquid refrigerant flowing into the heat medium relay unit 3B is branched after passing through a fully opened expansion device 16*d* and is expanded into a low-temperature low-pressure two-phase refrigerant by an expansion device 16*a* and an expansion device 16*b*.

This two-phase refrigerant flows into each of the heat exchanger related to heat medium 15*a* and the heat exchanger related to heat medium 15*b* functioning as an evaporator, removes heat from the heat medium circulating in the heat medium circuit B, cools the heat medium, and turns into a low-temperature low-pressure gas refrigerant. The gas refrigerant, which has flowed out of each of the heat exchanger related to heat medium 15*a* and the heat exchanger related to heat medium 15*b*, merges and flows out of the heat medium relay unit 3B through the corresponding one of a second refrigerant flow switching device 18*a* and a second refrigerant flow switching device 18*b*, passes through the refrigerant piping 4 (1), and again flows into the outdoor unit 1. The refrigerant flowing into the outdoor unit 1B, flow through the accumulator 19 and again is sucked into the compressor 10.

[Heating Only Operation Mode]

In this heating only operation mode, flow switching unit 41 is opened, and the flow switching unit 42 is closed.

A low-temperature low-pressure refrigerant is compressed by the compressor 10 and is discharged as a high-temperature high-pressure gas refrigerant therefrom. The entire high-temperature high-pressure gas refrigerant discharged from the compressor 10 flows through the refrigerant piping 4 (3) and out of the outdoor unit 1B. The high-temperature high-pressure gas refrigerant, which has flowed out of the outdoor unit 1B, passes through the refrigerant piping 4 (3) and flows into the heat medium relay unit 3B. The high-temperature high-pressure gas refrigerant that has flowed into the heat medium relay unit 3B is branched, passes through the second refrigerant flow switching device 18*a* and the second refrigerant flow switching device 18*b*, and flows into the heat exchanger related to heat medium 15*a* and the heat exchanger related to heat medium 15*b*.

The high-temperature high-pressure gas refrigerant that has flowed into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant in the expansion device 16*a* and the expansion device 16*b*. This two-phase refrigerant passes through the fully-opened expansion device 16*d*, flows out of the heat medium relay unit 3B, passes through the refrigerant piping 4 (2), and again flows into the outdoor unit 1B.

The refrigerant flowing into the outdoor unit 1B flows into the heat source side heat exchanger 12, functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the flow switching unit 41 and the accumulator 19 and is again sucked into the compressor 10.

[Cooling Main Operation Mode]

The cooling main operation mode will be described with respect to a case in which a cooling load is generated in the use side heat exchanger 26*a* and a heating load is generated in the use side heat exchanger 26*b*. Note that in the cooling main operation mode, flow switching unit 41 is closed, and the flow switching unit 42 is opened.

A low-temperature low-pressure refrigerant is compressed by the compressor 10 and is discharged as a high-temperature high-pressure gas refrigerant therefrom. A portion of the high-temperature high-pressure gas refrigerant discharged from the compressor 10 flows through the flow switching unit 42 into the heat source side heat exchanger 12. Then, the refrigerant is condensed into a high-pressure liquid refrigerant while transferring heat to outdoor air in the heat source side heat exchanger 12. The liquid refrigerant, which has flowed out of the heat source side heat exchanger 12, passes through the refrigerant piping 4 (2), flows into the heat medium relay unit 3B, and is slightly decompressed to medium pressure by the expansion device 16*d*. Meanwhile, the remaining high-temperature high-pressure gas refrigerant passes through the refrigerant piping 4 (3) and flows into the heat medium relay unit 3B. The high-temperature high-pressure refrigerant flowing into the heat medium relay unit 3B passes through the second refrigerant flow switching device 18*b*(2) and flows into the heat exchanger related to heat medium 15*b*, functioning as a condenser.

The high-temperature high-pressure gas refrigerant that has flowed into the heat medium heat exchanger 15*b* is condensed and liquefied while transferring heat to the heat medium circulating in the heat medium circuit B, and turns into a liquid refrigerant. The liquid refrigerant flowing out of the heat exchanger related to heat medium 15*b* is slightly decompressed to medium pressure by the expansion device 16*b* and is merged with the liquid refrigerant that has been decompressed to medium pressure by the expansion device 16*d*. The merged refrigerant is expanded by the expansion device 16*a* turning into a low-pressure two-phase refrigerant and flows into the heat exchanger related to heat medium 15*a* functioning as an evaporator. The low-pressure two-phase refrigerant flowing into the heat exchanger related to heat medium 15*a* removes heat from the heat medium circulating in the heat medium circuit B, cools the heat medium, and turns into a low-pressure gas refrigerant. This gas refrigerant flows out of the heat exchanger related to heat medium 15*a*, flows through the second refrigerant flow switching device 18*a*(1) out of the heat medium relay unit 3, passes through the refrigerant piping 4 (1), and again flows into the outdoor unit 1B. The refrigerant flowing into the outdoor unit 1B, flows through the accumulator 19 and is again sucked into the compressor 10.

[Heating Main Operation Mode]

The heating main operation mode will be described herein with respect to a case in which a heating load is generated in the use side heat exchanger 26*a* and a cooling load is generated in the use side heat exchanger 26*b*. Note that in the heating main operation mode, flow switching unit 41 is opened, and the flow switching unit 42 is closed.

A low-temperature low-pressure refrigerant is compressed by the compressor 10 and is discharged as a high-temperature high-pressure gas refrigerant therefrom. The entire high-temperature high-pressure gas refrigerant discharged from the compressor 10 flows through the refrigerant piping 4 (3) and out of the outdoor unit 1B. The high-temperature high-pressure gas refrigerant, which has flowed out of the outdoor unit 1B, passes through the refrigerant piping 4 (3) and flows into the heat medium relay unit 3B. The high-temperature high-pressure gas refrigerant flowing into the heat medium relay unit 3B passes through the second refrigerant flow switching device 18*b*(2) and flows into the heat exchanger related to heat medium 15*b*, functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant is branched into two, and one portion flows through the expansion device 16*a* into the heat exchanger related to heat medium 15*a*, functioning as an evaporator. The low-pressure two-phase refrigerant that has flowed into the heat exchanger related to heat medium 15*a* removes heat from the heat medium circulating in the heat medium circuit B, is evaporated, and cools the heat medium. This low-pressure two-phase refrigerant flows out of the heat exchanger related to heat medium 15*a*, turns into a low-temperature low-pressure gas refrigerant, passes through the second refrigerant flow switching device 18*a*(1), flows out of the heat medium relay unit 3B, passes through the refrigerant piping 4(1), and again flows into the outdoor unit 1. The two-phase low-pressure refrigerant, which had been branched after flowing through the expansion device 16*b*, passes through the fully-opened expansion device 16*d*, flows out of the heat medium relay unit 3B, passes through the refrigerant piping 4 (2), and flows into the outdoor unit 1B.

The refrigerant flowing through the refrigerant piping 4(2) and into the outdoor unit 1B flows into the heat source side heat exchanger 12, functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant that has flowed out of the heat source side heat exchanger 12 flows through the flow switching unit 41, merges with the low-temperature low-pressure gas refrigerant that has flowed into the outdoor unit 1B through the refrigerant piping 4(1), flows through the accumulator 19, and again is sucked into the compressor 10.

As described above, the air-conditioning apparatuses (the air-conditioning apparatus 100, air-conditioning apparatus 100A, and air-conditioning apparatus 100B) do not circulate the heat source side refrigerant to or near the indoor units 2 and do not allow the heat medium that has leaked out from the connection of each actuator and the pipings 5 to flow into the air conditioned spaces, thus increase safety. Furthermore, the pipings 5 can be shortened in the air-conditioning apparatus 100, thus energy saving can be achieved. Still further, the air-conditioning apparatus 100 can reduce the connecting pipings (refrigerant pipings 4 and pipings 5) between the outdoor unit 1 and the heat medium relay unit 3, and between the heat medium relay unit 3 and the indoor units 2, thus increase ease of construction.

REFERENCE SIGNS LIST

1 heat source unit (outdoor unit); 2 indoor unit; 2*a*, 2*b*, 2*c*, 2*d* indoor unit; 3, 3*a*, 3*b* heat medium relay unit; 4,4*a*,4*b* refrigerant piping; 5 piping in which a heat medium such as water or brine flows in; 6 outdoor space; 7 indoor space; 8 space outside a room such as a space above a ceiling and a space different from the indoor space; 9 structure such as a building; 10 compressor; 11 four-way valve (first refrigerant flow switching device); 12 heat source side heat exchanger; 13*a*, 13*b*, 13*c*, 13*d* check valve; 14 vent hole provided to the building; 15*a*, 15*b* heat exchanger related to heat medium; 16*a*, 16*b* expansion device; 17*a*, 17*b* on-off device; 18*a*, 18*b* second refrigerant flow switching device; 19 accumulator; 20 pipe shaft; 21*a*, 21*b* pump (heat medium sending device); 22*a*, 22*b*, 22*c*, 22*d* heat medium flow switching device; 23*a*, 23*b*, 23*c*, 23*d* heat medium flow switching device; 24 vent hole provided in the heat medium relay unit; 25*a*, 25*b*, 25*c*, 25*d* heat medium flow control device; 26*a*, 26*b*, 26*c*, 26*d* use side heat exchanger; 31*a*, 31*b* temperature detection device of the outlet of the heat exchanger related to heat medium; 34*a*, 34*b*, 34*c*, 34*d* temperature detection device of the outlet of the use side heat exchanger; 35*a*, 35*b*, 35*c*, 35*d* temperature detection device of refrigerant of the heat exchanger related to heat medium; 36 pressure detection device of the refrigerant of the heat exchanger related to heat medium; 50 housing; 51 air-sending device; 52 refrigerant concentration sensor; 53 control device; 61 fan for the space; 62 refrigerant concentration sensor for the space; 100 air-conditioning apparatus; 100A air-conditioning apparatus; 100B air-conditioning apparatus; A refrigerant circuit; B heat medium circuit.

The invention claimed is:

1. An air-conditioning apparatus, comprising:

a heat medium relay unit including a heat exchanger related to heat medium that exchanges heat between a flammable refrigerant and a heat medium different from the refrigerant and including a housing having a vent hole being formed to allow ventilation between an inside and an outside of a housing space, the heat medium relay unit disposed in a non-air conditioned space that is not an air conditioned space in a structure;

a single or a plurality of outdoor units being connected to the heat medium relay unit by piping to circulate the refrigerant therein, the single or the plurality of outdoor units being disposed in a space outside the structure or a space inside the structure that is not isolated completely from the space outside the structure; and a single or a plurality of indoor units being connected to the heat medium relay unit by piping to a different system to that of the outdoor units, the single or the plurality of indoor units circulating the heat medium therein to exchange heat with air related to the air conditioned space, wherein the non-air conditioned space can be ventilated to the space outside the structure by free convection or forced convection.

2. The air-conditioning apparatus of claim 1, wherein a perforated metal having processed holes as the vent hole is provided in at least a portion of the housing or one or more vent holes are provided on each of the two facing sides of the housing.

3. The air-conditioning apparatus of claim 1, further comprising an air-sending device for discharging gas from the housing space.

4. The air-conditioning apparatus of claim 3, further comprising:

a refrigerant concentration detection device detecting a concentration of the refrigerant in the housing space; and control means controlling the air-sending device such that a concentration of the refrigerant is not less than a predetermined value on the basis of the concentration of the refrigerant according to the detection of the refrigerant concentration detection device.

5. The air-conditioning apparatus of claim 1, wherein, the refrigerant is a refrigerant including a substance described as a chemical formula of $C_3H_mF_n$ (where m and n are integers of 1 to 5, and the relationship of m+n=6 holds) and possessing one double bond in its molecule structure; a mixed refrigerant in which the ratio of a refrigerant including the substance having a double bond to the entire mass of the mixed refrigerant is, by mass %, 20% to 90%, the mixed refrigerant including a HFC refrigerant therein; or a HFC refrigerant with flammability.

6. The air-conditioning apparatus of claim 1, wherein each of the plurality of indoor units and the heat medium relay unit are connected with a set of two pipings, and either of a cooled heat medium or a heated heat medium is allowed to selectively pass through each of the set of two pipings.

7. The air-conditioning apparatus of claim 6, wherein the heat medium relay unit comprises:

a heat exchanger for cooling that cools the heat medium and a heat exchanger for heating that heats the heat medium, as the heat exchanger related to heat medium;

an expansion valve that is provided between the heat exchanger for cooling and the heat exchanger for heating; and heat medium flow switching devices that switch the connection of the heat medium passage between each of the plurality of indoor units and the heat exchanger for cooling or the heat exchanger for heating so that when one or some heat exchanger is performing cooling, one or some of the remaining heat exchanger can perform heating.

8. The air-conditioning apparatus of claim 1, wherein the outdoor unit(s) and the heat medium relay unit is connected by two pipings.

9. The air-conditioning apparatus of claim 1, wherein the heat medium relay unit is disposed in the non-air conditioned space in which ventilation to the air conditioned space is not possible or a ventilation resistance to the air conditioned space is larger than a ventilation resistance to the space outside the structure.

10. The air-conditioning apparatus of claim 1, wherein at least the piping that is disposed in the space inside the structure among the pipings in which the refrigerant flow is covered with a pipe shaft, and ventilation between a space in the pipe shaft and the air conditioned space is not possible, a ventilation resistance to the non-air conditioned space or to the space outside the building is larger than a ventilation resistance of the space in the pipe shaft, or ventilation between the space of the piping space and the non-air conditioned space is possible.

11. The air-conditioning apparatus of claim 9, wherein the non-air conditioned space is the pipe shaft.

12. The air-conditioning apparatus of claim 9, wherein the non-air conditioned space is a space above a ceiling in the structure.

13. The air-conditioning apparatus of claim 1, further comprising an air-sending device for the space for the purpose of discharging gas from the non-air conditioned space to the space outside the structure.

14. The air-conditioning apparatus of claim 13, further comprising:

a refrigerant concentration detection device for the space detecting a concentration of the refrigerant in the non-air conditioned space; and control means controlling the air-sending device for the space such that a concentration of the refrigerant is not less than a predetermined value on the basis of the concentration of the refrigerant according to the detection of the refrigerant concentration detection device for the space.

15. The air-conditioning apparatus of claim 1, wherein the heat medium relay unit and the indoor unit(s) are disposed in the same space above the ceiling of the same floor and the difference of elevation of the piping in which the heat medium flows is smaller than a height of the space above the ceiling.

* * * * *